US006089130A

United States Patent [19]

Wu

[11] Patent Number: 6,089,130

[45] Date of Patent: Jul. 18, 2000

[54] ADJUSTABLE WRENCH HAVING WEIGHT REDUCING STRUCTURE

[76] Inventor: Arthur Wu, No. 41-12, Lane 548, Chong San Road, Shern Gan Hsiang, Taichung Hsien, Taiwan

[21] Appl. No.: 09/323,388

[22] Filed: Jun. 1, 1999

[51] Int. Cl.[7] ..... B25B 13/16; B25B 23/16

[52] U.S. Cl. ..... 81/170; 81/177.1

[58] Field of Search ..... 81/170, 177.1, 81/489; 16/110 R

[56] References Cited

U.S. PATENT DOCUMENTS

| | | | |
|---|---|---|---|
| 1,133,236 | 3/1915 | Peterson | 81/170 |
| 4,336,729 | 6/1982 | Eppenbach | 81/439 |
| 4,729,271 | 3/1988 | Kenigson | 81/489 |
| 5,211,085 | 5/1993 | Liou | 81/489 |
| 5,331,869 | 7/1994 | Webb | 81/177.1 |
| 5,390,572 | 2/1995 | Gakhar et al. | 81/177.1 |
| 5,588,343 | 12/1996 | Rust et al. | 81/489 |
| 5,768,727 | 6/1998 | Brainerd | 7/145 |
| 5,852,960 | 12/1998 | Wu | 81/177.1 |

*Primary Examiner*—Eileen P. Morgan
*Assistant Examiner*—Joni B. Danganan
*Attorney, Agent, or Firm*—Charles E. Baxley, Esq.

[57] ABSTRACT

An adjustable wrench includes a handle having a fixed jaw and a movable jaw disposed on one end and having a shank extended from the fixed jaw and a beam extended from the shank. The shank and the beam each includes one or more weight reducing depressions or apertures or orifices or notches. A sleeve is engaged on the beam and includes one or more studs and projections engaged into the orifices and notches of the beam for allowing the sleeve to be solidly secured to the beam. The beam includes a tapered structure for further securing the sleeve to the beam.

4 Claims, 2 Drawing Sheets

ADJUSTABLE WRENCH HAVING WEIGHT REDUCING STRUCTURE

BACKGROUND OF THE INVENTION

1. Field of the Invention

The present invention relates to an adjustable wrench, and more particularly to an adjustable wrench having a weight reducing structure.

2. Description of the Prior Art

Typical adjustable wrenches comprise a handle including a fixed jaw formed on one end and a movable jaw slidably received in the end of the handle and an slidable toward and away from the fixed jaw for engaging with and for driving fasteners. A screw is rotatably received in the end of the handle and engaged with the movable jaw for moving the movable jaw toward and away from the fixed jaw. The fixed jaw and the movable jaw may subject a great force while driving the fasteners. The adjustable wrenches are typically made of cast metals and include a great weight that is adverse for operation purposes. It is therefore impossible to further increase the size of the jaws for increasing the driving torque of the adjustable wrench, because the weight of the adjustable wrench may further be greatly increased and may not be easily operated. The adjustable wrench may also be made of lighter and stronger materials, such as the titanic materials. However, the costs of the materials are expensive.

The present invention has arisen to mitigate and/or obviate the afore-described disadvantages of the conventional adjustable wrenches.

SUMMARY OF THE INVENTION

The primary objective of the present invention is to provide an adjustable wrench including a handle having a weight reducing structure for allowing the driving head portion to be made with a greater weight and/or a greater strength.

In accordance with one aspect of the invention, there is provided an adjustable wrench comprising a handle including a first end having a head formed thereon and having a fixed jaw formed in the head and having a movable jaw slidably received in the head, the handle including a shank extended from the head of the handle and having at least one depression formed therein and having at least one aperture formed therein for reducing a weight of the handle, the handle including a beam extended from the shank, the beam including at least one orifice formed therein and including a peripheral portion having at least one notch formed therein, means for moving the movable jaw toward and away from the fixed jaw, and a sleeve engaged on the beam of the handle and including at least one stud engaged into the orifice of the beam and including at least one projection engaged into the notch of the beam, for allowing the sleeve to be solidly secured to the beam.

The shank of the handle includes at least one peripheral flange formed thereon for defining the depression of the shank. The projection of the sleeve and the notch of the beam include a ratchet-tooth shape for preventing the sleeve from being disengaged from the beam.

The beam includes a first end located close to the shank and includes a second end distal to the shank, the first end of the beam includes a size smaller than that of the second end of the beam for further securing the sleeve to the beam and for preventing the sleeve from being disengaged from the beam.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
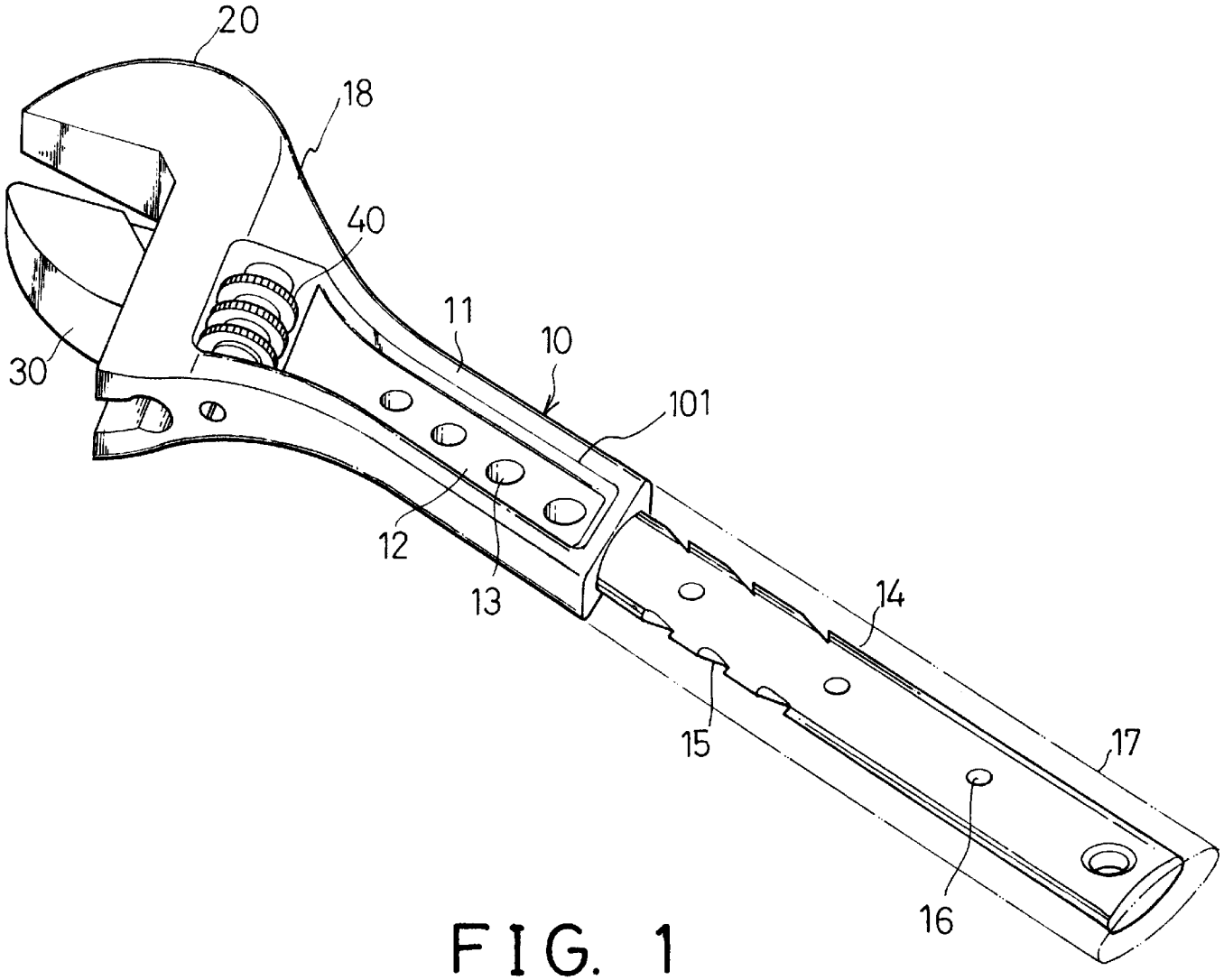
FIG. 1 is a perspective view of an adjustable wrench in accordance with the present invention, in which a sleeve for the handle is removed and is shown in dotted lines.

Referring to the drawings, an adjustable wrench in accordance with the present invention comprises a handle 10 including a head 18 formed on one end and having a fixed jaw 20 provided thereon and having a movable jaw 30 slidably received in the head 18 of the handle 10 and slidable toward and away from the fixed jaw 20 for engaging with and for driving fasteners. A screw 40 is rotatably received in the head 18 of the handle 10 and engaged with a rack 32 (FIG. 2) of the movable jaw 30 for moving the movable jaw 30 toward and away from the fixed jaw 20. The adjustable wrench in accordance with the present invention is to provide a handle 10 having a weight reducing structure for allowing the fixed jaw 20 and the movable jaw 30 to be made of a greater size and/or a greater strength.

The handle 10 includes a shank 101 formed integral with and extended from the head 18 of the handle 10 and includes the upper portion and the bottom portion each having a depression 12 formed therein and defined by a peripheral flange 11 for forming a weight reducing structure. The shank 101 further includes one or more apertures 13 formed therein for further decreasing the weight of the handle 10. The handle 10 further includes a beam 14 extended from the shank 101 and having a size smaller than that of the shank 101. The beam 14 includes one or more orifices 16 formed therein and includes a peripheral portion having one or more notches 15 formed therein. A sleeve 17 is applied onto the beam 14 and is made of such as rubber materials by molding processes, such that the user may feel comfort when grasping the soft and resilient sleeve 17. The materials for forming the sleeve 17 may include one or more studs 171 and projections 172 engaged into the orifices 16 and the notches 15 of the beam 14 respectively during the molding processes such that the sleeve 17 may further be solidly secured onto the beam 14. The notches 15 of the beam 14 and the materials of the sleeve 17 that engaged into the notches 15 include a ratchet-tooth shape for further solidly securing the sleeve 17 to the beam 14 and for preventing the sleeve 17 from being disengaged from the beam 14.

Figure 2:
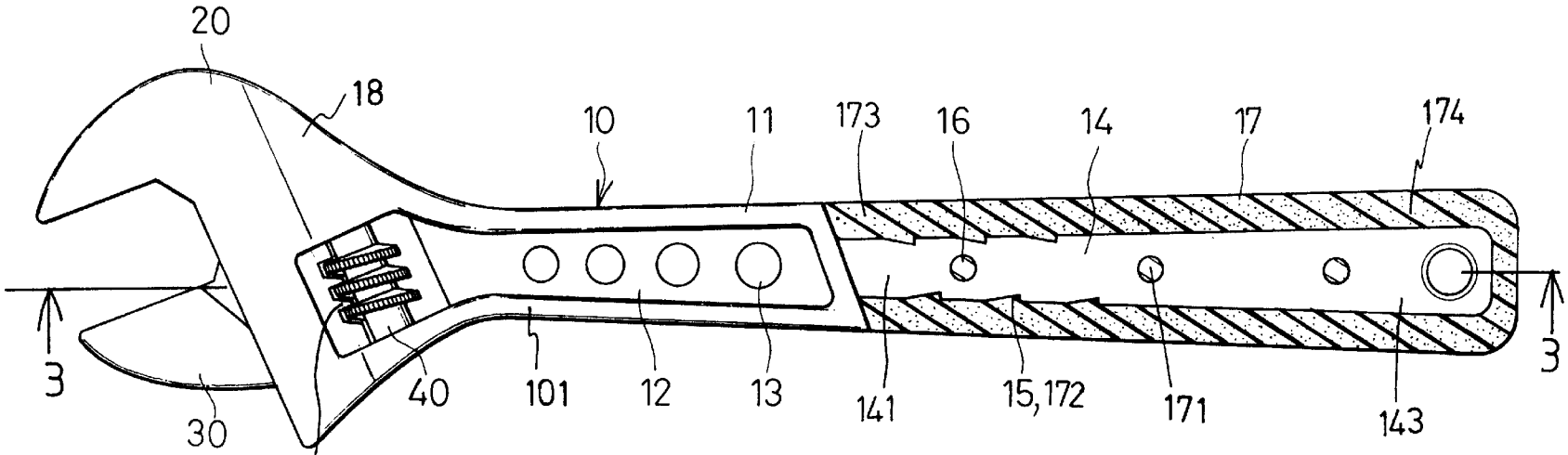
FIG. 2 is a cross sectional view taken along lines 2—2 of FIG. 3.
Figure 3:
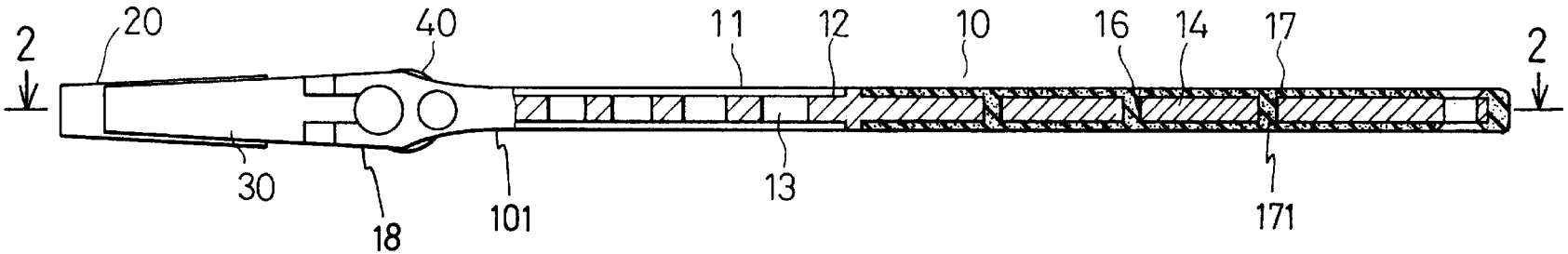
FIG. 3 is a cross sectional view taken along lines 3—3 of FIG. 2.

As best shown in FIG. 2, the beam 14 includes one end 141 located close to the shank 101 and having a size smaller than the other end 143 of the beam 14 and tapered toward the other end 143 of the beam 14, such that the corresponding one end 173 of the sleeve 17 includes a size smaller than the other end 174 thereof and such that the sleeve 17 may further be solidly secured to the beam 14. The one end 173 of the sleeve 17 includes an outer peripheral surface flush with that of the shank 101 of the handle 10.

The depression(s) 12 of the shank 101 of the handle 10, the aperture(s) 13 of the shank 101, the reduced size of the beam 14 relative to the shank 101, the orifice(s) 16 of the beam 14, and the notches 15 of the beam 14, may either or all be used to reduce the weight of the handle 10. The fixed jaw 20, and the movable jaw 30 of the head 18 of the adjustable wrench may thus be made of a greater size or a greater weight and a greater strength.

Accordingly, the adjustable wrench in accordance with the present invention includes a handle having a weight reducing structure for allowing the driving head portion to be made with a greater weight and/or a greater strength.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable wrench comprising:

a handle including a first end having a head formed thereon and having a fixed jaw formed in said head and having a movable jaw slidably received in said head, means for moving said movable jaw toward and away from said fixed jaw, said handle including a shank extended from said head of said handle and having at least one depression formed therein and having at least one aperture formed therein for reducing a weight of said handle, said handle including a beam extended from said shank, said beam including at least one orifice formed therein and including a peripheral portion having at least one notch formed therein, and a sleeve engaged on said beam of said handle and including at least one stud engaged into said at least one orifice of said beam and including at least one projection engaged into said at least one notch of said beam, for allowing said sleeve to be solidly secured to said beam.

2. The adjustable wrench according to claim 1, wherein said shank of said handle includes at least one peripheral flange formed thereon for defining said at least one depression of said shank.

3. The adjustable wrench according to claim 1, wherein said at least one projection of said sleeve and said at least one notch of said beam include a ratchet-tooth shape for preventing said sleeve from being disengaged from said beam.

4. The adjustable wrench according to claim 1, wherein said beam includes a first end located close to said shank and includes a second end distal to said shank, said first end of said beam includes a size smaller than that of said second end of said beam for further securing said sleeve to said beam and for preventing said sleeve from being disengaged from said beam.

* * * * *